US008556128B2

(12) United States Patent
Harper

(10) Patent No.: US 8,556,128 B2
(45) Date of Patent: Oct. 15, 2013

(54) DISPENSING CHANNEL PUMP

(76) Inventor: William A. Harper, Redmond, WA (US)

( * ) Notice: Subject to any disclaimer, the term of this patent is extended or adjusted under 35 U.S.C. 154(b) by 258 days.

(21) Appl. No.: 12/927,336

(22) Filed: Nov. 12, 2010

(65) Prior Publication Data

US 2012/0118915 A1 May 17, 2012

(51) Int. Cl.
*B65D 37/00* (2006.01)

(52) U.S. Cl.
USPC ..... 222/207; 222/94; 222/494; 222/395; 222/105

(58) Field of Classification Search
USPC ..... 222/94, 95, 96, 105, 395, 207, 494
See application file for complete search history.

(56) References Cited

U.S. PATENT DOCUMENTS

| | | | | |
|---|---|---|---|---|
| 2,777,612 | A | 12/1957 | Bensen | |
| 4,331,264 | A * | 5/1982 | Staar | 222/94 |
| 5,067,635 | A | 11/1991 | Thomsen | |
| 5,099,885 | A | 3/1992 | Nilsson | |
| 5,176,510 | A * | 1/1993 | Nilsson | 417/479 |
| 5,207,355 | A | 5/1993 | Thomsen | |
| 5,431,634 | A | 7/1995 | Brown | |
| 5,810,203 | A | 9/1998 | Brennan | |
| 6,789,706 | B2 | 9/2004 | Abergel | |
| 7,322,491 | B2 | 1/2008 | Py | |
| 7,828,176 | B2 | 11/2010 | Harper | |
| 7,887,231 | B2 * | 2/2011 | Suchan et al. | 366/130 |
| 8,038,034 | B2 * | 10/2011 | Pelfrey | 222/153.13 |
| 8,061,566 | B2 * | 11/2011 | Laflamme et al. | 222/207 |
| 8,083,103 | B2 * | 12/2011 | Laflamme et al. | 222/135 |
| 8,132,696 | B2 * | 3/2012 | Mileti | 222/207 |
| 8,292,120 | B2 * | 10/2012 | Laflamme et al. | 222/94 |
| 2007/0262091 | A1 * | 11/2007 | Harper | 222/207 |
| 2011/0017771 | A1 * | 1/2011 | Obrsit et al. | 222/1 |

* cited by examiner

*Primary Examiner* — Paul R Durand
*Assistant Examiner* — Donnell Long

(57) ABSTRACT

A hand operated fluid dispenser comprised of a sealed flexible reservoir chamber containing a fluid, a channel capable of blockage by finger pressure applied to a specific position, a flexible pump chamber drawing fluid from the reservoir via this channel, and a pump cycled by external finger pressure applied to a layered array of the channel and pump chamber. This class of simple, inexpensive, disposable dispensers is particularly useful in packaging cosmetics, foodstuffs, and healthcare products. As pocketable dispensers they are popular for conveniently dispensing small amounts of stored viscous liquids easily damaged when exposure to the atmosphere, a condition where sealed reservoirs coupled with airless pumps work together successfully preventing product contamination, deterioration and loss.

20 Claims, 3 Drawing Sheets

DISPENSING CHANNEL PUMP

FIELD OF THE INVENTION

The present invention relates to hand operated fluid dispensers utilizing a sealed flexible reservoir chamber containing a fluid, a flexible pump chamber, and a pump action cycled by application of finger pressure. This class of simple, disposable dispensers is particularly useful in packaging and distributing of cosmetics, foodstuffs, and healthcare products. As pocketable packet dispensers they are popular for conveniently dispensing small amounts of stored fluids and viscous liquids easily damaged when exposed to the atmosphere, a condition where the sealed reservoir coupled with an airless pump work together precluding product contamination, deterioration and loss.

BACKGROUND OF THE INVENTION

Dispersal of relatively viscous liquids such as liquid soaps, hand sanitizing fluids, cosmetic creams, insect repellant lotions and similar fluids is often accomplished by either squeezing plastic tubes or bottles with closable caps or pumping fluid from bottles with reciprocating ball-valve pumps accessed by top mounted plungers. Conventional dispensers of these types dominate the marketplace for packaging dispensable viscous fluids and range in size from small pocketable packets to large jugs. Such containers are universally popular despite being well known for wasting irretrievable product, inconvenient handling, unfortunate leaks, content contamination problems and product loss through evaporation.

The art of packaging has long offered solution to some of these shortcomings. For example, Bensen U.S. Pat. No. 2,777,612 (1957) disclosed a tube dispenser with a collapsible inner product pouch associated with a pneumatic pump system to dispense most of the viscous liquid product while protecting it from atmospheric contamination. Three examples of external pumps using a reciprocating chamber are Nilsson U.S. Pat. No. 5,099,885 (1992), Thomsen U.S. Pat. No. 5,067,635 (1991), and Thomsen U.S. Pat. No. 5,207,355 (1993). Nilsson disclosed a dispensing pump with an elastic pump chamber, deformable under direct pressure, and the subsequent hydraulic pressure closing an inlet valve and opening an outlet valve. Thomsen discloses two forms of an exterior dispensing pump with elements arrayed linearly that relies on a sequencing mechanism that first closes the inlet passage from the reservoir, then builds subsequent pressure in pump chamber resulting in fluid dispensing from an exit valve. An internal pump design is disclosed by Abergel U.S. Pat. No. 6,789,706 (2004). Abergel describes a pump chamber enclosed by a reservoir wall that communicates pressure to the pump which builds fluid pressure that activates both outlet and inlet valves for discharging and refill. Brennan U.S. Pat. No. 5,810,203 (1998), Brown U.S. Pat. No. 5,431,634 (1995), and Py U.S. Pat. No. 7,322,491 (2008) all disclose various additional elements of pump closure art. A simple, low-cost pump design is described by Harper U.S. Pat. No. 7,828,176 (2010). Harper discloses a reservoir chamber and dispersal pump chamber providing fluidic access through a closable aperture in a common pump wall. Aside from Harper, none of these disclosures neither describes nor suggests a particularly low-cost, minimal part pump action that is easy to manufacture and convenient to operate. The need for a fluid dispenser that employs an internal pump in thin compact packaging of minimal construction remains open to new designs.

SUMMARY OF THE INVENTION

The present invention recognizes the abundance of the prior art and contributes a specific advancement over that art. Accordingly it is a particular intent of the present invention to provide a simple internal pump mechanism exemplified by placing such a pump within a pouch reservoir forming a liquid dispenser of such size and shape as to be carried in a pocket or hung about a neck and thus promoting convenient access to and timely use of the entire liquid product held within. Specifically, the pump located inside the liquid reservoir does not employ a one-way inlet valve for controlling liquid entering the pump chamber from the reservoir chamber as taught by the prior art represented by various check-ball designs. Further, the pump action of the current invention does not employ a one-way inlet mechanism controlling liquid entering the pump chamber as taught in prior art; nor does the current disclosure teach the teat pinch/squeeze technique found in other art. Instead, the flexible fluidic passage between the reservoir and pump chamber is located so a portion of the passageway channel is pressed shut by direct linear finger pressure so that, because the channel is layered with the pump chamber, continued finger pressure is transmitted to the adjoining pump chamber so as to pressurize the fluid within the pump chamber by volumetric distortion which is then forced thru a one-way exit valve for dispersal. When the channel becomes unblocked absent the external pressure holding the channel walls together and the pump chamber returns to its original undistorted volume, reservoir fluid refills the chamber with fluid moving thru the unblocked channel from the reservoir. Because the channel and pump chamber are arrayed each on the other in a layered fashion a tactile and/or visual cuing means indicating application of finger pressure on a particular location is helpful to properly perform a pump cycle action requiring the closure of the channel and pressurizing of the pump chamber.

This simple pump, essentially a combination of several film walls, an exit valve, and a channel/chamber layered array, requires a minimal number of components and materials. Yet, surprisingly, this design has proven to be very effective, durable, and highly reliable. Because the pump is easily squeezed by a variety of hand and finger configurations it has proven particularly useful for persons with limited hand mobility where a stripping action to discharge the fluid is problematic without benefit of a mechanical interface. Also, by placing the pump array within the reservoir an overall flat, thin, even stylish package is created; such packaging significantly facilitates convenient access and timely use. Finally, the simplicity of the overall design of the pump, reservoir, channel and exit valve, all of which can be constructed of various flexible polymer films of differing elastic properties, is of such a nature as to facilitate simple and reliable manufacturing at extremely low-costs while making use of minimal amounts of materials.

It is therefore the principal objective of this invention to provide a new and improved fluid dispensing pump, incorporating device and method capable of repeatedly delivering doses of liquid in a controlled and efficient manner.

A specific object of this invention is to provide a fluid dispenser which is of such few parts and simple design as to be readily adaptable to a straightforward and economical manufacturing process.

Another object of the present invention is to create a fluid dispenser that can effectively expel substantially all of the fluid held within the reservoir and pump chamber.

Further objects of the invention are to allow the design of dispensing devices so compact as to be pocketable to facilitate convenient fluid usage, so inexpensive to manufacture as to be disposable, so reliable as to provide carefree service, and so simple to operate that they are easily manipulated by small, weak, impaired, or even lamed hands.

These and other objects and advantages of the present invention will become apparent from the following description taken in conjunction where appropriate with the accompanying drawings wherein are set forth, by way of illustrations and example, certain embodiments of this invention. The drawings constitute a part of this specification and include exemplary embodiments of the present invention that illustrate various objects and features thereof.

BRIEF DESCRIPTION OF THE DRAWINGS

The invention will be better understood and objects other than those set forth above will become apparent when consideration is given to the following detailed description thereof. Reference is made in the following briefly described drawings, wherein like reference numbers refer to corresponding elements.

DETAILED DESCRIPTION OF THE INVENTION

While the invention will be described in connection with illustrations, descriptions, and examples of preferred embodiments, it will be understood these are not intended to limit the present invention only to these embodiments. On the contrary, the present invention is to cover all structural and/or functional alternatives as generally described.

The term "direct finger pressure" as used herein refers to single unidirectional, unsequenced, non-mechanical, immediate pressure applied by a finger to a single area of a layered pump configuration comprising a fluid inlet channel and fluid pump chamber both capable of being compressed and thereby achieving pressurization and subsequent dispersal of pump chamber fluid through a predetermined one-way exit. The term element "finger" as used herein refers to any combination of pressures applied to the pump assembly by the thumb, palm, finger and/or fingers of a hand. By way of contrast, this direct finger pressure applied to disperse fluid by means of a layered pump construct is not characterized as mimicking a milking or stripping motion where multiple areas involving several components arrayed in a linear fashion are sequentially manipulated by multiple discrete pressures applied by fingers or mechanical contrivances to expel fluids.

The term "fluid" as used herein refers to the broad, common dictionary meaning denoting a flowable material of all kind and applies to any particular liquid or gas, including each and every streamable thin or viscous fluidal material. Descriptive categories of various dispensed fluids include cosmetics, foodstuffs, healthcare products, adhesives, lubricants and representative products such as liquid soaps, hand sanitizing fluids, facial creams, insect lotions, liquid medications, condiments, lubricating greases, hair conditioners, and any of the myriad of materials with flowable properties.

The term "fluid dispenser" encompasses both a pump mechanism and the incorporation of that mechanism in packaging that dispenses fluid for use. All the operational elements describing the pump are incorporated in any expression of such packaging to achieve the utility made possible by the pump mechanism. All forms of such a packaging utility are envisioned by the herein disclosed invention.

Following are two exemplifying embodiments which depict the elements and interactions in representative forms and structures of the present invention.

Example 1

Figure 1:
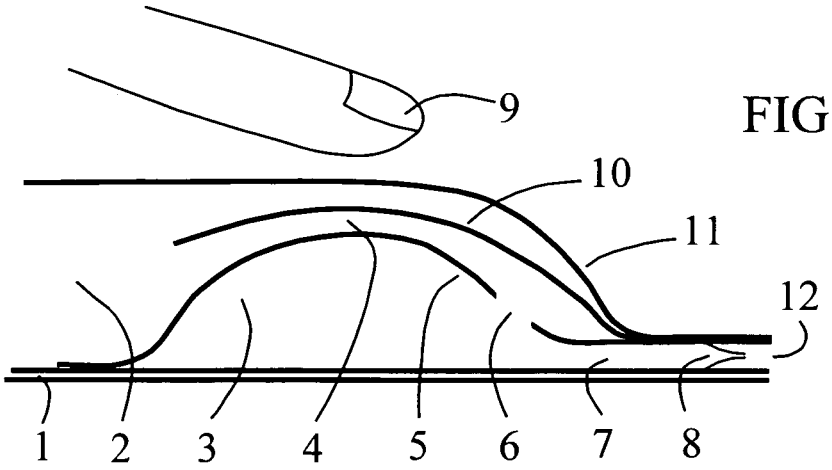
FIG. 1 is a side view of a sealed fluid dispenser with a pump chamber layered below a channel providing fluidic passage between the reservoir and the pump chamber via an aperture.

In FIG. 1 a cut through side view of the pump assembly of a fluid dispenser is illustrated. Comprising elements include a base 1 which is attached by peripheral seal to a fluid reservoir of which a flexible portion of the upper reservoir wall 11 is shown. The reservoir wall 11 fully encloses a fluid material as product contained within the reservoir chamber 2, this fluid is also found in and in fluidic communication with fluid in the channel 4, pump chamber 3, and dispensing channel 7. All fluid is sealed away from the atmosphere so as to exclude fluid product contamination, prevent deterioration, and eliminate quantitative loss. The fluid held within the reservoir 2, channels, and pump chamber 3 has only one outlet to the atmosphere, through a one-way exit valve 8 and out an orifice 12 for dispersal. The valve 8 may consist of any one or more known types including duckbill, check, compression, elastic, flap, reed, spring, and similar one-way mechanisms. All, by their operational characteristics, provide protection form atmospheric interaction with the fluid product stored within the dispensing device here defined by the reservoir wall 11 and base 1. The fluid in the reservoir chamber 2 is in fluidic communication with fluid in the pump chamber 3 by way of the channel 4 which overlays the pump chamber 3. In this example the channel 4 is formed of two walls, an upper channel wall 10 which separates the channel fluid from the reservoir chamber 2 fluid, and a lower pump chamber wall 5 which separates channel 4 fluid from the pump chamber 3 fluid. These two flexible walls, the channel wall 10 and pump wall 5, are peripherally sealed together on three sides so as to form a flexibly resilient arched channel 4 open on one end to allow fluidic communication with the reservoir chamber 2. Near the opposite closed end of the channel 4 is located an aperture 6 in the pump wall 5 which also allows fluidic communication with the pump chamber 3 and consequently permits fluidic communication via the channel 4 with the reservoir chamber 2. A finger 9 is shown poised over the pump dispenser prepared to apply pressure.

Figure 2:
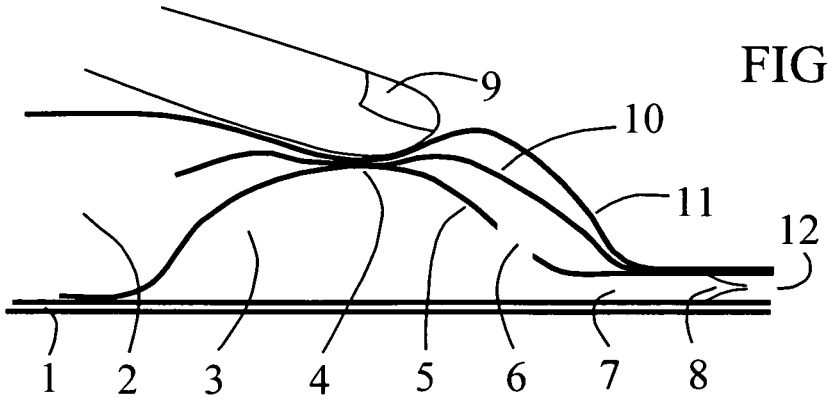
FIG. 2 is a side view after the previous figure showing a flexible reservoir front wall, a flexible channel and a pump chamber; pressure applied by a finger has closed the channel and is about to deform the pump chamber so as to build internal fluidic pressure.

In FIG. 2 a cut through side view of the dispensing pump assembly of the fluid dispenser shows the finger 9 beginning to apply pressure to the pump. The finger 9 has pressed the flexible reservoir wall 11 down into contact with the channel wall 10 and pushed the flexible, resistively deformable channel wall 10 of predetermined shape down on to the pump wall 5 effectively blocking the channel 4, such blockage in the channel 4 cuts off fluidic communication between the pump chamber 3 and the reservoir chamber 2. The resilient aspect of the channel wall 10 which normally forms an arch and keeps open the channel 4 has been overcome and flattened by the external pressure applied by the finger 9. Displaced fluid within the reservoir chamber 2 caused by the deformation has moved to other positions within the reservoir chamber 2 as permitted by the slack and/or elastic nature of the reservation wall 10. It is noted the application of finger pressure applied anywhere other than a location which first close the channel 4 and then pressurizes the pump will simply shift fluid around from chamber to chamber and will not develop sufficient pump chamber 3 pressure to expel fluid product through the exit valve 8.

Figure 3:
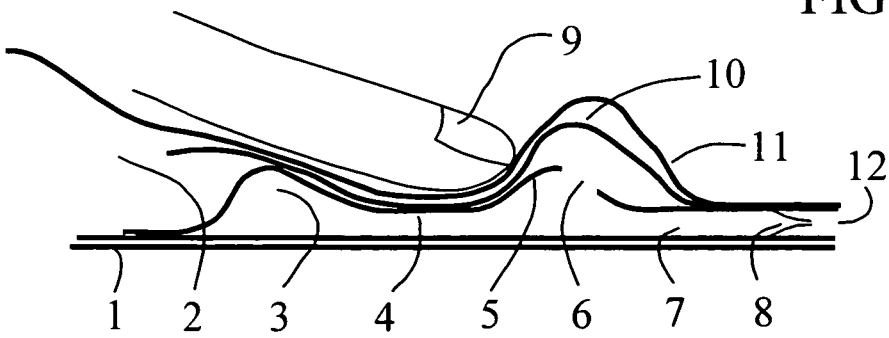
FIG. 3 is a side view of the previous figures showing a finger applying pressure to the pump through the reservoir wall, shutting the channel passageway, and deforming the flexible pump chamber by compression so as to disperse the pressurized fluid product therein thru the exit valve and orifice.

In FIG. 3 the finger 9 pressure begun in FIG. 2 has continued so as to deform and volumetrically reduce the flexible, resistive predetermined shape of the pump chamber 3 as formed by a property and/or structure of the pump chamber wall 5. This deformation pressurizes the fluid trapped within the pump chamber 3 because fluid communication via the channel 4 is still blocked by previous pressure as illustrated and described in FIG. 2. The pressurized fluid within the pump chamber 3 becomes sufficiently pressurized to overcome the predetermined pressure threshold holding the one-way valve 8 closed in a normal state so as to open the valve 8 and dispense a quantity of fluid through the orifice 12 in a measured, repeatable dose or as a varied amount dependent upon the selectable degree of pump chamber 3 deformation created by finger 9 induced pressure. Key to achieving this dispersal is that the channel 4 and pump chamber 3 have been arrayed on to the other in a layered fashion so that application of direct linear finger pressure deforms each together. Additionally, the flexible materials forming the channel 4 has resilient deformable properties characterized as less resistive than those of the pump chamber 3 so as to cause the channel wall 10 to respond first to deforming finger 9 pressure that blocks the channel 4 before developing significant pressurization of pump chamber 3 fluid. It is important this channel 4, being flexible with resistive deformable properties of predetermined shape, have a portion capable of being compressed by sufficient finger 9 pressure so the channel walls can selectively block fluid passage as communication between the reservoir chamber 2 and pump chamber 3.

Completing the pump cycle begins by removing the finger 9 pressure as illustrated in FIG. 3 to that shown in FIG. 1. As depicted in FIG. 1, where there is an absence of finger 9 pressure, the channel 4 is unblocked by the resilient resistively deformable characteristic of the channel 4 and has opened the channel 4 to fluidic communication, the pressure deformed pump chamber 3 has regained its normal predetermined shape and volume, and the pump chamber 3 has refilled with fluid obtained from the reservoir chamber 2 via passage through the unblocked channel 4. The dispensing channel pump and its incorporating device are ready for another pump cycle to dispense fluid.

Figure 4:
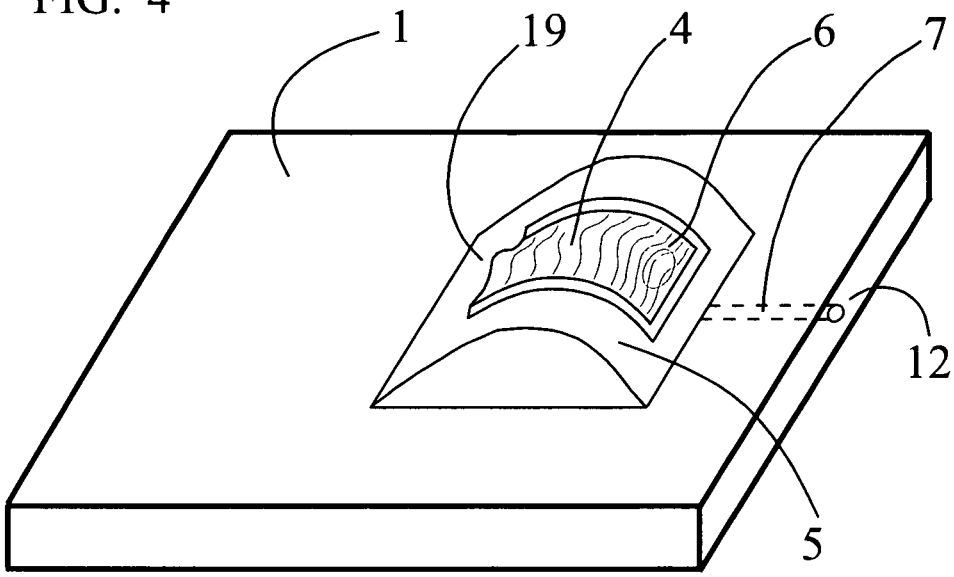
FIG. 4 is a perspective view of a fluid dispenser showing a base incorporating a dispensing channel with external orifice upon which is mounted a pump chamber overlain with a channel mechanism.

In FIG. 4 a perspective view shows a base 1, pump wall 5, and channel 4 arrayed in a layered fashion without an obscuring reservoir wall 11. This relational view shows a typical peripheral attachment of the channel wall to the pump wall 5, the location of a single channel inlet 19 for intake to the channel 4 of reservoir chamber fluid, and the pump chamber aperture 6 at the other end of the channel 4. The pump wall 5 of predetermined resistive resilience and shape is sealed to the base 1 which is shown to incorporate the distribution channel 7 leading to an orifice 12 employed to dispersed the pressurized pump chamber fluid.

Figure 5:
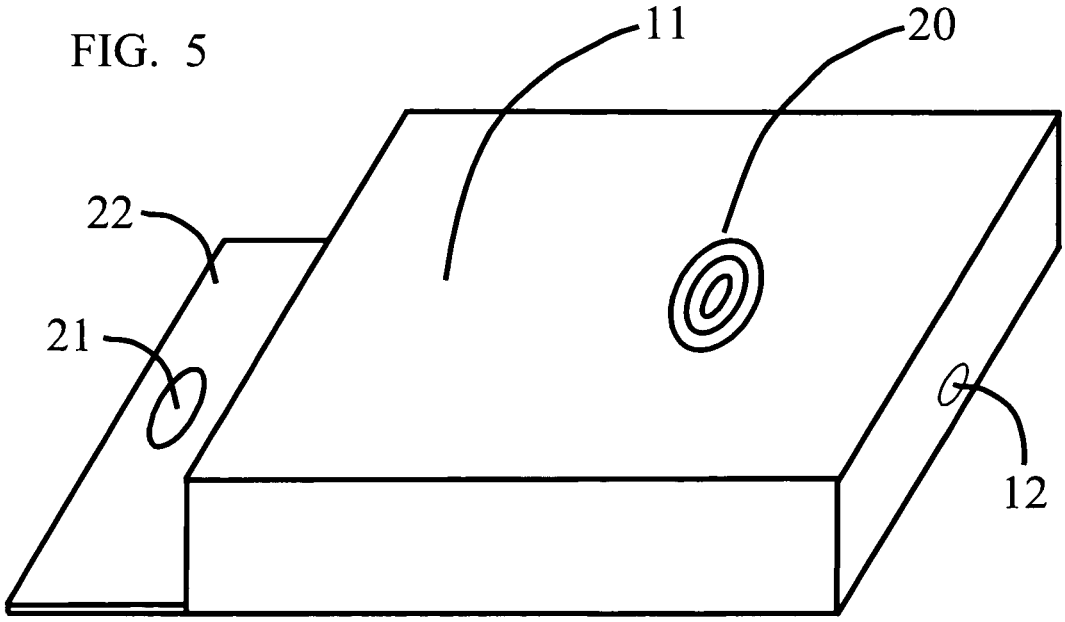
FIG. 5 is a perspective view of the previous figure showing the pump chamber and channel hidden by the exterior wall of a reservoir upon which is shown a cuing device indicating where finger pressure needs to be applied to execute a pump cycle.

In FIG. 5 a perspective view shows the representation of FIG. 4 covered by a reservoir wall 11 sealed to the base so as to hold and protect the fluid product within. Added to the base is a stiff base 22 extension to facilitate handling and/or providing an attachment means, here represented by an attachment hole 21. The fluid dispenser as a packaging unit though primarily designed to be characterized as pocketable in size, utility, and shape can also be attached, hung and/or carried by persons or objects. Various attachment means include adhesives, buckles, buttons, clasps, fasteners, holes, lanyards, loops, magnets, pins, rivets, screws, twists, ties, Velcro, and similar devices. Also newly shown is a cuing 20 means where, since the appropriate location to apply finger pressure that blocks the channel and pressurizes the pump chamber is obscured, such a cuing 20 device is useful in locating the specific physical point where pressure must be applied to successfully cycle the pump. The cuing means 20 is detectable by tactile and/or visual senses and positioned on at least one appropriate surface of the pump chamber, channel wall and/or reservoir chamber. The cuing means 20 may take any form as may be made by printing, embossing, casting and other techniques discernable by a tactile and/or visible sense.

Example 2

Figure 6:
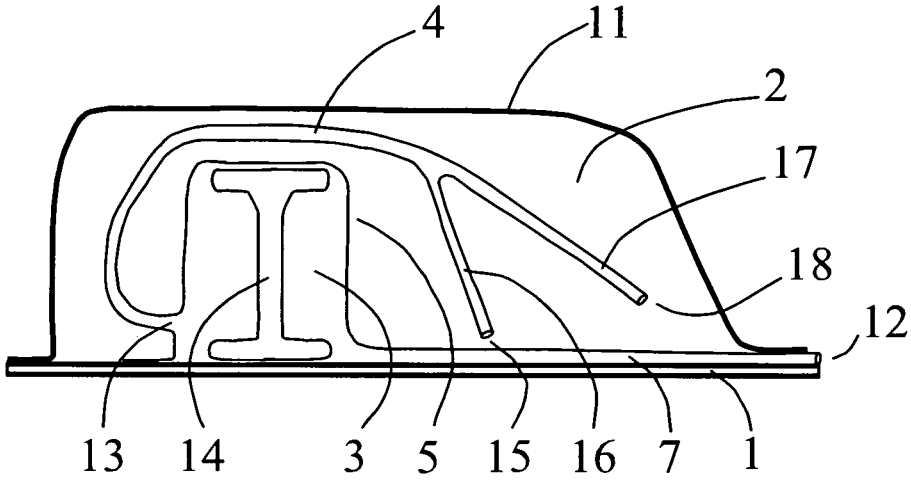
FIG. 6 is a side view of a sealed fluid dispenser utilizing a multi-inlet channel as a pipe for fluid collection from the reservoir laying across the pump chamber incorporating an internal resilient spring that restores pump chamber volume.

In FIG. 6 a cut through side view of the pump assembly of a fluid dispenser is illustrated in a fashion similar to FIG. 1. The familiar elements of base 1, reservoir wall 11, pump chamber 3, reservoir chamber 2, dispensing channel 7, orifice 12, channel 4, and pump wall 5 are again shown. Additionally, new features are illustrated which include a channel 4 which is depicted as a pipe whose wall is formed independent of any other pump component and has plural channel inlets formed, in this example, by bifurcated pip extensions defined as a mid pipe 16 and far pipe 17. Each of these pipes terminates in an inlet respectively described as mid inlet 15 and far inlet 18. Various placements of such inlets at diverse locations within the reservoir chamber 2 allows the gathering of fluid product so as to eliminate or greatly reduce irretrievable wastage. Also newly illustrated is a pump element described as a spring 14 which, by its resistive resilient nature, aids in both defining the predetermined shape and volumetric capacity of the pump chamber 3 in which it is enclosed. Such a spring 14 assists in or even fully restores the capacity the pump wall 5 to maintain and reform the predetermined shape and volume of the pump chamber 3 after pressure caused deformation is removed. As in FIG. 1 fluidic communication exists between the reservoir chamber 2 and pump chamber 3 via the inlets 15 18, channel 4, and pump inlet 13. Dispersal of pressurized fluid is from the pump chamber 3, through the dispenser channel 7, exit valve 8, and orifice 12.

Figure 7:
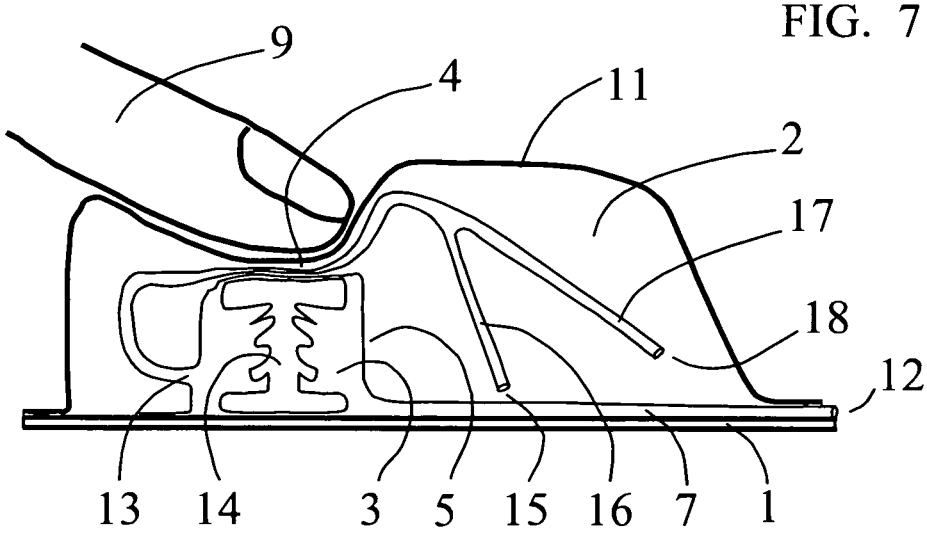
FIG. 7 is a side view of the previous figure showing finger applying pressure to the pump through the reservoir walls, such pressure closing the channel with remote bifurcated inlets, and compressing the pump chamber to dispense the resulting pressurized fluid therein thru the exit valve and orifice.

In FIG. 7 a cut through side view after FIG. 6 shows a finger 9 applying pressure at the appropriate position to pinch the pipe channel 4 closed so as to block fluidic communication as previously described and illustrated by FIG. 2. Continued finger 9 pressure is shown to have pressurized the pump chamber 3 by volumetric reduction and distortion of the pump spring 14 in the manner previously described and illustrated by FIG. 3. Removal of finger pressure restores the various components to that represented in FIG. 6 and ready for a new pump cycle of fluid dispersal.

It is to be understood that even though numerous characteristics and advantages of the present invention have been set forth in the foregoing description, together with details of the structure, function, and employment of the invention, the disclosures are illustrative only, and changes may be made in details, especially in matters of shape, size, and arrangement of some parts together with content and materials utilized, within the principles of the invention to the full extent indicated by the broad general meaning of the terms as expressed.

Further, throughout this specification various patents are referenced. The disclosures of these references in their entireties are hereby incorporated by reference in order to more fully describe the state of the art to which the invention pertains. What has been illustrated and described herein are improvement in certain types of hand squeezable articles of manufacture and a new pump design making possible these improvements. One example of the utility of such fluid dispensers with channel pump designs is to dispense hand sanitizing fluid for hand rubbing and thereby improving hand hygiene in a population with the intent of significantly reducing the frequency of pathogenic transmission and subsequently reduce sickness and infectious disease within that population. Key to any such a successful outcome is the timely availability of the dispenser as needed. By hanging dispensers described previously in Example 1 and Example 2 from the necks or clothing of healthcare workers such as nurses and doctors for their ready access, a dramatic and substantial reduction in nosocomial infections can be expected in a hospital or clinic population.

While these improvements have been illustrated and described with reference to certain preferred embodiments, the present invention is not limited thereto. In particular, the foregoing specification and embodiments are intended to be illustrative and are not to be taken as limiting. Thus, alternatives, such as structural or mechanical or functional equivalents, and other modifications will become apparent to those skilled in the art upon reading the foregoing description.

What is claimed is:

1. A fluid dispenser, comprising:

a reservoir chamber and a pump chamber, both chambers having at least one flexible wall surface and containing a fluid;

said pump chamber being a flexible, resistive predetermined shape capable of volumetric reduction by deforming under sufficient finger pressure so as to pressurize pump fluid contained within;

a channel with at least one flexible wall positioned between said reservoir wall and said pump chamber wall and providing fluidic passage between said chambers;

said channel being flexible, resistively deformable of predetermined shape, a portion capable of being compressed by sufficient finger pressure so said channel wall blocks fluid passage;

said channel having resilient deformable properties characterized as less resistive than said pump chamber resistive properties so as to cause said channel walls to respond first to deforming said finger pressure to block said channel before developing significant pressurizing of said pump chamber fluid;

said channel and said pump chamber being so arrayed one to the other in a layered fashion so that application of direct linear finger pressure deforms each together to compress said portion of said channel by said direct finger pressure sufficient to block fluid passage thru said channel and to pressurize pump chamber fluid blocked from moving thru said channel;

a dispensing channel with a one-way valve providing exiting fluidic communication between said pump chamber and an orifice for discharging said pressurized pump chamber fluid; and, whereby said pump chamber develops sufficient fluidic pressure from said finger pressure to discharge said pressurized channel blocked pump chamber fluid thru said dispensing channel to exit through said orifice and absent said finger pressure said resilient channel unblocks and said resilient pump chamber reforms undeformed shape and thereby draws in said fluid from said reservoir chamber thru said unblocked channel completing a pump cycle.

2. The fluid dispenser of claim 1 wherein said valve is a duckbill, check, compression, elastic, flap, reed, slit, spring, or similar one-way valve.

3. The fluid dispenser of claim 1 wherein said finger pressure is applied by the thumb, palm, finger and/or fingers of a hand.

4. The fluid dispenser of claim 1 wherein the resistive resilience of said pump chamber is provided by an interior resilient material and/or spring enclosed by said pump chamber.

5. The fluid dispenser of claim 1 wherein the resistive resilience of said pump chamber is provided by a property and/or structure of the pump chamber walls.

6. The fluid dispenser of claim 1 wherein said dispenser is a flexible pouch and said pump chamber is fully or partially enclosed by said reservoir chamber.

7. The fluid dispenser of claim 1 further comprising a cuing means associated with at least one surface position of said pump chamber, channel wall and/or reservoir chamber aiding in the application of finger pressure at the appropriate location to pressurize pump fluid.

8. The fluid dispenser of claim 7 wherein said cuing means is detectable by a tactile and/or visual sense.

9. The fluid dispenser of claim 1 being of a size and utility characterized as being pocketable.

10. The fluid dispenser of claim 1 with at least one relatively stiff reservoir wall to facilitate handling and/or attachment.

11. The fluid dispenser of claim 1 wherein said dispenser further comprising an attachment means enabling said dispenser to be attached to, hung on, and/or carried by a person or object.

12. The fluid dispenser of claim 11 wherein said attachment means is selected from a group consisting of adhesives, buckles, buttons, clasps, fasteners, holes, lanyards, loops, magnets, pins, rivets, screws, twists, ties, Velcro or combinations thereof.

13. The fluid dispenser of claim 1 wherein both pump and reservoir chambers are sealed from atmospheric contamination and/or loss of fluidic quality and/or quantity.

14. The fluid dispenser of claim 1 wherein a measured, repeatable dose quantity of fluid is dispersed by each said pump cycle.

15. The fluid dispenser of claim 1 wherein a varied dose quantity of fluid is dispersed by each said pump cycle.

16. The fluid dispenser of claim 1 wherein said channel has a single reservoir chamber inlet for reservoir chamber fluid to entering said fluidic passage.

17. The fluid dispenser of claim 1 further comprising plural channel inlets for gathering reservoir chamber fluid into said fluidic passage.

18. The fluid dispenser of claim 17 wherein said inlets gather said reservoir chamber fluid from at least two separated locations within said reservoir chamber.

19. A fluid dispenser, comprising:

a reservoir chamber and a pump chamber, both chambers having at least one flexible wall surface and containing a fluid;

said pump chamber being a flexible, resistive predetermined shape capable of volumetric reduction by deforming under sufficient finger pressure so as to pressurize pump fluid contained within;

a channel with at least one flexible wall and providing fluidic passage between chambers, said channel in said reservoir chamber having plural inlets gathering said reservoir chamber fluid from at least two separate locations;

said channel being flexible, resistively deformable of predetermined shape, a portion identified by a tactile and/or visual cuing means, capable of being compressed by sufficient finger pressure so said channel wall blocks fluid passage;

said channel having resilient deformable properties characterized as less resistive than said pump chamber resistive properties so as to cause said channel walls to respond first to deforming said finger pressure to block said fluid passage before developing significant pressurizing of said pump chamber fluid;

said channel and said pump chamber being superimposed one on the other in a layered fashion so application of direct linear finger pressure deforms each together to compress said portion of said channel by said direct finger pressure sufficient to block fluid passage thru said channel and to pressurize pump chamber fluid blocked from moving thru said passage;

a dispensing channel with a one-way valve providing exiting fluidic communication between said pump chamber and an orifice for discharging said pressurized pump chamber fluid; and, whereby said pump chamber develops sufficient fluidic pressure from said finger pressure to discharge said pressurized channel blocked pump chamber fluid thru said dispensing channel to exit through said orifice and absent said finger pressure said resilient channel unblocks and said resilient pump chamber reforms undeformed shape and thereby draws in said fluid from said reservoir chamber thru said unblocked channel completing a pump cycle.

20. A method of fluid dispensing, comprising steps of:

providing a reservoir chamber and a pump chamber, both chambers having at least one flexible wall surface and containing a fluid, said pump chamber being a flexible, resistive predetermined shape capable of volumetric reduction by deforming under sufficient finger pressure so as to pressurize pump fluid contained within;

providing a channel with at least one flexible wall positioned between said reservoir wall and said pump chamber wall and providing fluidic passage between said chambers, said channel being flexible, resistively deformable of predetermined shape, a portion capable of being compressed by sufficient finger pressure so said channel wall blocks fluid passage;

providing said channel with resilient deformable properties characterized as less resistive than said pump chamber resistive properties so as to cause said channel walls to respond first to deforming said finger pressure to block said fluid passage before developing significant pressurizing of said pump chamber fluid;

arraying said channel and said pump chamber one to the other in a layered fashion so that application of direct linear finger pressure deforms each together to compress said portion of said channel identified by a tactile and/or visual cuing means by said direct finger pressure sufficient to block fluid passage thru said channel and to pressurize pump chamber fluid blocked from moving thru said passage;

providing a dispensing channel with a one-way valve providing exiting fluidic communication between said pump chamber and an orifice for discharging said pressurized pump chamber fluid; and, compressing said pump chamber develops sufficient fluidic pressure from said finger pressure to discharge said pressurized channel blocked pump chamber fluid thru said dispensing channel to exit through said orifice and absent said finger pressure said resilient channel unblocks and said resilient pump chamber reforms undeformed shape and thereby draws in said fluid from said reservoir chamber thru said unblocked channel completing a pump cycle.

* * * * *